United States Patent [19]

Van Buskirk

[11] 4,096,479

[45] Jun. 20, 1978

[54] RADAR SIGNIFICANT TARGET

[75] Inventor: Lyman F. Van Buskirk, Ridgecrest, Calif.

[73] Assignee: The United States of America as represented by the Secretary of the Navy, Washington, D.C.

[21] Appl. No.: 787,732

[22] Filed: Apr. 14, 1977

[51] Int. Cl.[2] ..... H01Q 15/18

[52] U.S. Cl. ..... 343/18 C

[58] Field of Search ..... 343/18 C

[56] References Cited

U.S. PATENT DOCUMENTS

| | | | |
|---|---|---|---|
| 2,310,790 | 2/1943 | Jungersen | 343/18 C X |
| 3,039,093 | 6/1952 | Rockwood | 343/18 C |
| 3,153,235 | 10/1964 | Chatelain | 343/18 C |
| 3,200,400 | 8/1965 | Gill, Jr. | 343/18 C |
| 3,276,017 | 9/1966 | Mullin | 343/18 C |

FOREIGN PATENT DOCUMENTS

| | | | |
|---|---|---|---|
| 696,834 | 9/1953 | United Kingdom | 343/18 C |

*Primary Examiner*—T.H. Tubbesing

*Attorney, Agent, or Firm*—R. S. Sciascia; Roy Miller

[57] ABSTRACT

A corner reflector and method of making the same by molding individual panels with a plurality of corner reflectors formed in each panel, joining the panels in a desired shape and filling the central portion of the target reflector formed thereby with a buoyant material.

6 Claims, 3 Drawing Figures

RADAR SIGNIFICANT TARGET

BACKGROUND OF THE INVENTION

1. Field of the Invention.

Corner reflectors comprised of a plurality of radar reflecting surfaces may be used to practice radar procedures on at sea by ships and aircraft or as decoys to confuse an enemy radar system. Other uses might comprise identifying the position of a person or an object which is in distress or lost on land or at sea.

Corner reflectors are useful in that they are the most efficient way of retro-directing light or radar energy back to its source. The corner reflector ordinarily comprises three plane reflective surfaces set mutually perpendicular to each other so as to define the internal corner angle of a cube.

Such a reflector has the property of reflecting along a path parallel to the incident pathways striking any of its surfaces from any direction within the solid angle defined by the surfaces.

2. Description of the Prior Art.

Corner reflectors have been constructed by connecting together a number of plane surfaces made of rigid material such as sheet metal; by connecting together a number of panels made of a flexible, collapsible lightweight material having a reflecting material adhered thereto; or by connecting together a number of panels made of a flexible, collapsible metallic fabric. The later two types of reflectors require the use of a rigid frame work or other support structure for maintaining the reflector in a proper reflecting condition. In addition, if the reflector is to be used on water, some means must be provided for maintaining the reflector above the surface of the water.

Inflatable structures have been effectively used to suspend and support a radar reflector in various types of environments. One commonly used type of inflatable structure is an inflatable spherical balloon having some means for suspending the reflector inside of the balloon. Such a balloon, when inflated with gas, exerts a uniform radial tension, which is an important factor in reducing the number of surface imperfections. However, the spherical balloon is not entirely satisfactory. One disadvantage of using a balloon as a support structure is that it is difficult to construct, therefore resulting in relatively high construction cost. Another disadvantage of a spherical balloon is that a relatively large volume of gas is required to inflate it; therefore, this type of unit is best suited for small sizes.

U.S. Pat. Nos. 3,217,325 and 3,276,017 are examples of inflatable support structures wherein a foam such as polystyrene foam may be used to either rigidize the support or the panels forming the corner reflector. In U.S. Pat. No. 3,217,325, the support structure is inflated with a hardenable foam substance so that a rigid support structure is formed after the foam hardens. In U.S. Pat. No. 3,276,017, the corner reflector is formed of fabric comprising two sheets with a gap therebetween which is then filled with a foam hardenable substance.

SUMMARY OF THE INVENTION

The purpose of the present invention is to provide a light-weight easily fabricated and assembled array of corner reflectors which may be used as radar targets, decoys or for any other desired purpose. In such applications, an array of small corner reflectors may be formed in the shape of equilateral triangles for assembly into a 20 sided geodesic structure, icosahedron, or in rollup rectangular strips.

The panels may be fabricated by casting or Vacuforming thermoplastic materials against an array of right-regular tetrahedrons which are the exact negative of the corner reflectors required. After molding, the outer surfaces of the corner reflectors are ordinarily painted with a conductive paint.

The equilateral triangular shaped panels may then be assembled into the icosahedron shape with a suitable connector or adhesive. After that is done, the interior of the icosahedron may be injected with a suitable buoyant material. The buoyant material may be any conventional material such as foaming polyurethane or polystyrene.

A rectangular panel may be formed into a continuous roll in the shape of a cylinder and then may be deployed with floats to simulate large ships. The hollow cylinder may also be filled with polyurethane or polystyrene foam to render it buoyant.

The resulting structures are lightweight and will float even after being holed with bullets or bombs, they are rigid, and may be equipped with a strobe light for recovery at night. In addition, the icosahedron shape may be supported by a balloon or parachute for use as an aerial target.

DESCRIPTION OF THE PREFERRED EMBODIMENT

Figure 1:
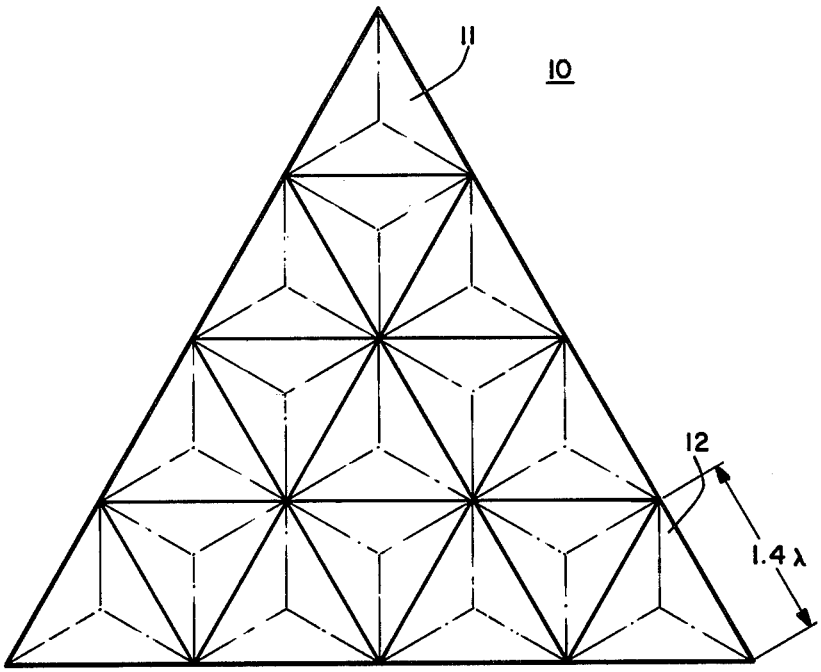
FIG. 1 is a plan view of one panel incorporating the array of corner reflectors.

FIG. 1 is a plan view of one panel 10 formed in the shape of an equilateral triangle having an array of corner reflectors 11 formed therein. Each of the corner reflectors has three edges and comprises an equilateral triangle also. Preferably the length of an edge, such as edge 12, of an individual triangle is approximately 1.4 times the wavelength of the radar of interest.

The dimension of approximately 1.4 times the wavelength of the radar to be used results in making the corner reflectors somewhat insensitive to frequencies much lower than the design frequency. Surface irregularities due to forming errors or caused by melting due to the paint tend to limit response to higher frequencies and the result is a reflector that is responsive to a rather narrow band of frequencies, thereby increasing signal-to-noise ratio of the target to the desired radar band.

The panels are formed of a suitable thermoplastic such as polyvinyl chloride or Plexiglass. Fabrication of panels is by casting or Vacuforming the thermoplastic materials against an array of right-regular tetrahedrons which are the exact negative of the corner reflectors required for the array. After forming the panel, the outer surface of the corner reflectors is sprayed with a radar reflective paint, i.e., a conductive material. These materials are old in the art and are therefore not explained in detail.

Figure 2:
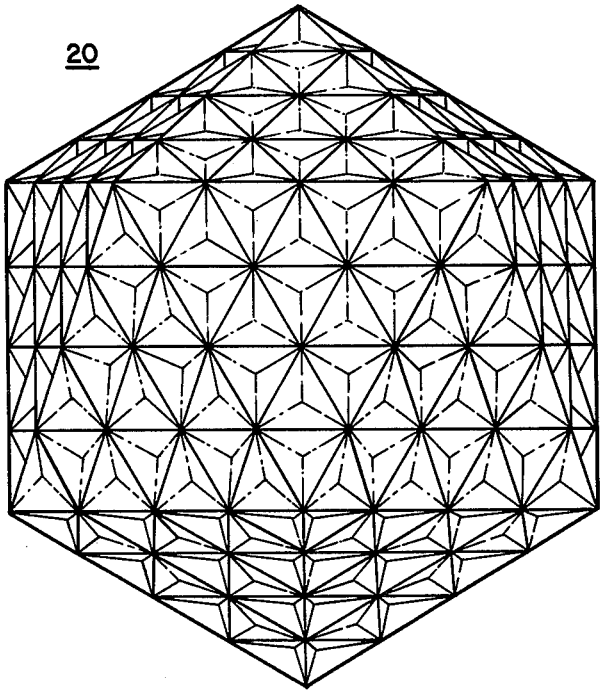
FIG. 2 illustrates twenty panels formed in the shape of an icosahedron.

The individual panels may then be joined together by a suitable adhesive or connectors such as clips, etc. in the form of an icosahedron 20 illustrated in FIG. 2. After the panels are joined together, a suitable bouyant material such as a polyurethane foam or polystyrene is injected into the interior of the icosahedron. This may be done by either leaving one of the panels of the 20 sides off temporarily or injecting the foam via a needle into the interior. It is also to be understood that the panel of FIG. 1 could be formed as the front surface of a tetrahedron made of styrofoam material and 20 such units could then be cemented together to form an icosahedron with each face of the icosahedron being a radar reflective panel.

Figure 3:
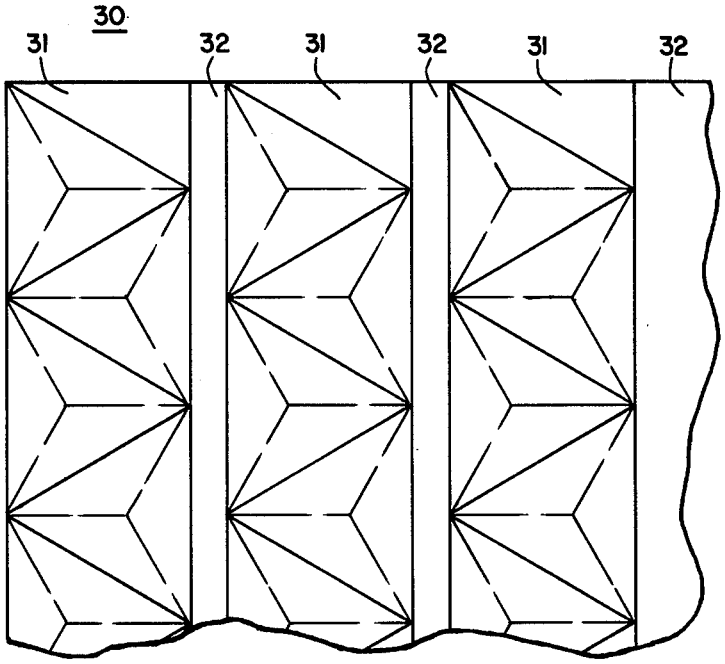
FIG. 3 is the plan view of a section of the rectangular panels adapted for formation into a cylinder.

In an alternate application, as shown in FIG. 3, a continuous roll of the array of radar reflectors may be used to approximate a large ship to a radar. A rectangular panel 30 comprises individual panels 31 having arrays formed thereon. The individual panels are separated by a narrow portion as at 32 having no corner reflectors formed therein. Upon forming the overall panel 30 into a cylinder, the bending occurs mainly in the portions 32. After the panel 30 is formed into a cylinder, it may be either supported by floats upon deployment in water or the interior of the cylinder may be filled again with a suitable foam such as polystyrene or polyurethane foam. Again, the outer surface of the individual corner reflectors is painted with suitable conductive paint which will reflect the radar waves.

An icosahedron such as illustrated in FIG. 2 may also be supported by a balloon or parachute for use as an aerial target if desired.

The production of either icosahedron or sheet reflectors is inexpensive utilizing the technique disclosed. The method results in lightweight buoyant targets or decoys which can be formed aboard an operating ship at sea. The icosahedron is essentially non-sensitive as to orientation with respect to the active radar and can be used many times even though full of holes due to the buoyant material contained therein. This is also true of course with respect to the cylinder if it too contains a buoyant material.

It is to be understood that the individual panels might also be formed of metallized plastic film as well as the thermoplastic which is then sprayed or coated with a conductive material or paint.

What is claimed is:

1. A radar reflective target comprising:

at least one panel having inner and outer faces;

a plurality of radar reflective corner reflectors formed in the outer face of the panel;

each of said plurality of corner reflectors being comprised of intersecting surfaces;

a radar reflective coating on the surfaces of said plurality of corner reflectors;

said at least one panel comprising the outer surface of a tetrahedron; and the inner portion of said tetrahedron abutting the inner face of said at least one panel being comprised of a buoyant material.

2. A radar reflective target as set forth in claim 1 wherein;

said target is formed in the shape of a cylinder of a desired length; and the inner portion of said cylinder is filled with a buoyant material.

said buoyant material comprises polystyrene foam.

3. A radar reflective target as set forth in claim 2 wherein;

said buoyant material comprises polystyrene foam.

4. A radar reflective target as set forth in claim 1 wherein;

said target is formed in the shape of an icosahedron.

5. A radar reflective target as set forth in claim 4 wherein;

the inner portion of the icosahedron is filled with a bouyant material.

6. A radar reflective target as set forth in claim 5 wherein;

said buoyant material comprises polystyrene foam.

* * * * *